US010415511B2

(12) United States Patent
Makino et al.

(10) Patent No.: US 10,415,511 B2
(45) Date of Patent: Sep. 17, 2019

(54) EVAPORATED FUEL PROCESSING DEVICES

(71) Applicant: AISAN KOGYO KABUSHIKI KAISHA, Obu-shi, Aichi-ken (JP)

(72) Inventors: Katsuhiko Makino, Aichi-ken (JP); Atsushi Sugimoto, Aichi-ken (JP); Keisuke Wakamatsu, Aichi-ken (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 15/571,260

(22) PCT Filed: Mar. 23, 2016

(86) PCT No.: PCT/JP2016/059105
§ 371 (c)(1),
(2) Date: Nov. 1, 2017

(87) PCT Pub. No.: WO2016/185786
PCT Pub. Date: Nov. 24, 2016

(65) Prior Publication Data

US 2018/0347511 A1 Dec. 6, 2018

(30) Foreign Application Priority Data

May 15, 2015 (JP) ..... 2015-099976

(51) Int. Cl.
*F02M 25/08* (2006.01)
*F02D 41/00* (2006.01)
(Continued)

(52) U.S. Cl.
CPC ..... *F02M 25/089* (2013.01); *F02D 13/0234* (2013.01); *F02D 41/003* (2013.01);
(Continued)

(58) Field of Classification Search
CPC ..... F02M 25/089; F02M 25/0836; F02M 25/0845; F02M 25/0854; F02D 41/004;
(Continued)

(56) References Cited

U.S. PATENT DOCUMENTS 5,257,916 A * 11/1993 Tuckey ..... F02M 37/048 415/55.2
5,702,229 A * 12/1997 Moss ..... F02M 37/048 415/55.1
(Continued)

FOREIGN PATENT DOCUMENTS

CN 103180593 A 6/2013
JP S58160590 A 9/1983
(Continued)

OTHER PUBLICATIONS

PCT/JP2016/059105 International Search Report and Written Opinion dated May 31, 2016 (7 p.).
(Continued)

*Primary Examiner* — Mahmoud Gimie
(74) *Attorney, Agent, or Firm* — Conley Rose, P.C.

(57) ABSTRACT

An evaporated fuel processing device includes a fuel tank, a canister, an atmospheric passage, a vapor passage, an intake pipe, a purge passage, a purge pump, and a flow rate control valve. The evaporated fuel is desorbed utilizing only negative pressure in the intake pipe when sufficient negative pressure is generated in the intake pipe. The purge pump is driven to desorb the evaporated from the canister when sufficient negative pressure is not generated in the intake pipe. The purge pump and the flow rate control valve may be provided in the purge passage. The purge pump is a vortex pump through which the gas can flow even when drive is stopped. The minimum cross-sectional area of the internal space of the flow passage of the purge pump is equal
(Continued)

to or larger than the minimum cross-sectional area of the internal space of the other parts of the purge passage.

20 Claims, 3 Drawing Sheets

(51) Int. Cl.
*F02D 13/02* (2006.01)
*F04D 23/00* (2006.01)
*F04D 25/00* (2006.01)
*F04D 29/40* (2006.01)

(52) U.S. Cl.
CPC ..... *F02D 41/004* (2013.01); *F02D 41/0032* (2013.01); *F02M 25/08* (2013.01); *F02M 25/0836* (2013.01); *F02M 25/0854* (2013.01); *F04D 23/008* (2013.01); *F04D 25/00* (2013.01); *F04D 29/403* (2013.01); *F02M 2025/0845* (2013.01)

(58) Field of Classification Search
CPC ..... F02D 19/0621; F02D 41/003; F02D 41/0032
USPC ..... 123/516, 518–520
See application file for complete search history.

(56) References Cited

U.S. PATENT DOCUMENTS 6,138,644 A * 10/2000 Saruwatari ..... F02D 41/004 123/519
6,247,458 B1 * 6/2001 Heinemann ..... F02M 25/0818 123/516
6,732,718 B2 5/2004 Kano et al.
7,575,410 B2 8/2009 Uchida et al.
2004/0025851 A1 * 2/2004 Krimmer ..... F02M 25/0836 123/522
2007/0077138 A1 * 4/2007 Tsuzuki ..... F04D 29/188 415/55.1
2013/0213366 A1 * 8/2013 Weigl ..... F02D 29/02 123/520
2013/0319378 A1 12/2013 Haag et al.
2015/0285170 A1 * 10/2015 Nanba ..... F02D 41/004 123/520
2015/0345411 A1 12/2015 Ooiwa

FOREIGN PATENT DOCUMENTS

JP 2002256986 A 9/2002
JP 2003042014 A 2/2003
JP 2006283702 A 10/2006
JP 2007162588 A 6/2007
JP 2015229925 A 12/2015

OTHER PUBLICATIONS

Japanese Office Action dated Jun. 22, 2018, for Japanese Application No. 2015-099976 (3 p.).
English Translation of Japanese Office Action dated Jun. 22, 2018, for Japanese Application No. 2015-099976 (3 p.).
Chinese Office Action dated Mar. 8, 2019, for Chinese Application No. 201680024001.7 (14 p.).

* cited by examiner

EVAPORATED FUEL PROCESSING DEVICES

CROSS-REFERENCE TO RELATED APPLICATIONS

The present application is a National Phase entry of, and claims priority to, PCT Application No. PCT/JP2016/059105, filed Mar. 23, 2016 which claims priority to Japanese Patent Application No. 2015-099976, filed May 15, 2015, both of which are incorporated by reference herein in their entireties for all purposes.

STATEMENT REGARDING FEDERALLY SPONSORED RESEARCH OR DEVELOPMENT

Not applicable.

BACKGROUND

The present invention relates to an evaporated fuel processing device.

An evaporated fuel processing device includes, for example, a fuel tank, a canister for adsorbing evaporated fuel generated in the fuel tank, an atmospheric passage for facilitating communication between the canister and the atmosphere, and a vapor passage for facilitating communication between the fuel tank and the canister. The evaporated fuel processing device further includes an intake pipe for supplying the atmospheric air to an internal combustion engine, a purge passage for communicating the intake pipe with the canister, and a purge pump for forcibly pumping the air from the canister toward the intake pipe. When sufficient negative pressure is generated in the intake pipe, the purge pump is stopped so that the evaporated fuel is desorbed (purged) from inside the canister towards the intake pipe utilizing only the negative pressure in the intake pipe. On the other hand, when sufficient negative pressure is not generated in the intake pipe, the purge pump is driven so that the evaporated fuel is desorbed (purged) from the inside the canister towards the intake pipe.

This type of the evaporated fuel processing device is disclosed, for example, in Japanese-Laid Open Patent Publication No. 2002-256986 and No. 2007-162588. In Japanese-Laid Open Patent Publication No. 2002-256986, a double acting type diaphragm pump is used as a purge pump in order to prevent the fuel vapor from being diffused out of the canister into the atmosphere even when the purge pump is broken. In this way, passage sealing performance can be ensured while the pump is stopped even when the purge pump is broken.

In Japanese-Laid Open Patent Publication No. 2007-162588, a specific vane pump is adopted as a purge pump. The vane pump includes a vane accommodating means, such as a tension spring, which attracts a plurality of vanes to the center of rotation thereof. Therefore, when the purge pump is driven, the centrifugal force causes the tension spring to extend so that the vanes move outwardly in a radial direction to discharge the gas under the pressure. On the other hand, each vane is attracted to the center of rotation due to the biasing force of the tension spring while the purge pump is stopped so that a suction side communicates with the discharge side. As a result, the desorption efficiency of the evaporated fuel is improved since the flow passage of the gas is secured even when the purge pump is stopped. Further, in Japanese-Laid Open Patent Publication No. 2007-162588, the purge pump is provided on the atmospheric passage. However, the gas flowability during oil feeding can be ensured since the flow passage is secured even when the purge pump is stopped.

BRIEF SUMMARY

In Japanese-Laid Open Patent Publication No. 2002-256986, a passage is completely sealed (closed) when the purge pump is stopped. Therefore, it is extremely inefficient in desorbing the evaporated fuel from the canister utilizing only the negative pressure in the intake pipe. In order to avoid this inefficiency, a configuration to form a bypass passage with a bypass valve is also disclosed. However, by doing so, there is an inevitable cost increase due to increase in the number of components as well as increase in size and/or complexity.

On the other hand, a vane pump used in Japanese-Laid Open Patent Publication No. 2007-162588 allows the gas to flow even when the pump is stopped, thus such a problem described in Japanese-Laid Open Patent Publication No. 2002-256986 will not arise. However, a separate problem is that a specific vane pump must be used in Japanese-Laid Open Patent Publication No. 2007-162588. Moreover, the dimension aspect (cross-sectional area) of the internal space constituting a gas flow passage in the vane pump is not considered. Consequently, the vane pump may be a passage resistance (pressure loss part) which would diminish the desorption efficiency of the evaporated fuel when the minimum cross-sectional area of the internal space of the vane pump leading from the suction port to the discharge port is smaller than the minimum cross-sectional area of the internal space in the purge passage. In addition, because the vane pump is provided on the atmospheric passage in Japanese-Laid Open Patent Publication No. 2007-162588, the gas flowability during oil feeding is also diminished.

Therefore, there is a conventional need for an evaporated fuel processing device wherein the desorption efficiency of desorbing the evaporated fuel from inside the canister is less likely diminished in utilizing only negative pressure in the intake pipe after the purge pump is stopped while sufficient negative pressure is generated in the intake pipe.

According to one aspect of the present invention, an evaporated fuel processing device includes a fuel tank, a canister for adsorbing evaporated fuel generated in the fuel tank, an atmospheric passage for facilitating communication between the canister and the atmosphere, and a vapor passage for facilitating communication between the fuel tank and the canister. The evaporated fuel processing device further includes an intake pipe for supplying an atmospheric air to an internal combustion engine, a purge passage for communicating the intake pipe with the canister, and a purge pump for pumping an air from the canister to the intake pipe. The evaporated fuel is desorbed from inside the canister utilizing negative pressure in the intake pipe by stopping the purge pump when the magnitude or absolute value of the negative pressure in the intake pipe is larger than a predetermined value. The purge pump is driven to pump the air such that the evaporated fuel is desorbed from inside the canister when the absolute value of the negative pressure in the intake pipe is smaller than the predetermined value or when the pressure in the intake pipe is at a positive pressure. The gas flows through the canister and the purge passage to the intake pipe while the atmospheric air is introduced as the air for facilitating the purge when the evaporated fuel is desorbed from inside the canister. "The gas" may include, for example, one or both of the evaporated fuel and air (atmospheric air) for facilitating the purging of the evaporated fuel. "The gas" may also be referred to as, for example, evaporated fuel-containing gas.

The purge pump is provided in the purge passage. The purge pump is a vortex pump through which the gas can flow even when the purge pump is stopped and not being driven. The purge pump includes a disk-like impeller and a housing configured to accommodate the impeller, wherein the disk-like impeller includes a plurality grooves or vanes that are arranged along an outer peripheral edge of the disk-like impeller and arranged parallel to each other, and wherein the pump housing has a suction port and a discharge port. The impeller rotates around an axis within the housing. A flow passage is defined within the pump housing to enclose the outer peripheral edge of the impeller, wherein the flow passage is configured such that it always maintains communication between the suction port and the discharge port. The minimum cross-sectional area of an internal space of a passage leading from the suction port of the purge pump via the flow passage to the discharge port is equal to or larger than the minimum cross-sectional area of an internal space of pipes for the atmospheric passage, the canister and the purge passage.

Specifically, the minimum cross-sectional area of the passage within the purge pump is equal to or larger than the minimum cross-sectional area of the pipes for the atmospheric passage, the canister and the purge passage that serve as gas flow passages when desorbing the evaporated fuel from the canister. Therefore, the pressure loss per unit length of the passage from the suction port of the pump housing via the flow passage to the discharge port of the purge pump will be equal to or less than the pressure loss per length of the pipes for the atmospheric passage, the canister and the purge passage. The "length" is, for example, a dimension in the gas flow direction. A "cross-sectional area of the internal space of the canister" is, for example, the sum of the void areas defined between each adsorption material for adsorbing the evaporated fuel wherein the each adsorption material is accommodated in an adsorption chamber.

Therefore, when the evaporated fuel is desorbed from the canister, the gas can flow within the purge pump utilizing only the negative pressure in the intake pipe. The purge pump is a vortex pump that may be configured relatively simply compared to conventional vane pumps having a specific structure. Further, the minimum cross-sectional area of the internal space in the purge pump is equal to or larger than the minimum cross-sectional area of the other parts constituting the purge passage. Consequently, the pressure loss within the purge pump will be less than the pressure loss in the other parts constituting the purge passage. In this manner, with the appropriate structural configuration, the purge pump can be prevented from becoming a passage obstacle due to resistance (pressure loss part) when the evaporated fuel is desorbed from the canister by utilizing only negative pressure in the intake pipe. Thereby, it is possible to prevent the desorption efficiency from being diminished when the evaporated fuel is desorbed by utilizing only negative pressure in the intake pipe.

In another aspect, the flow rate control valve may be provided closer to the canister side than the purge pump in the purge passage. Specifically, if the flow direction of the gas during desorption of the evaporated fuel is determined as a purge direction, the flow rate control valve is provided, for example, at the upstream of the purge pump in the purge direction, that is, closer to the canister side.

For example, the following advantages may be achieved if the flow rate control valve is arranged upstream of the purge pump in the purge direction. Firstly, the level of the negative pressure in the purge passage and the canister can be adjusted in accordance with the level of negative pressure in the intake pipe. Secondly, it is possible to prevent the evaporated fuel from being diffused into the atmosphere via the atmospheric passage when positive pressure acts on the canister immediately after the purge pump is stopped if the purge passage is blocked. This can be achieved by closing the flow rate control valve, proximate the purge pump, at the same time as the purge pump is stopped. Thirdly, the evaporated fuel from the fuel tank can be reliably delivered to the canister if the purge passage is blocked by closing the flow rate control valve during oil feeding etc.

In another aspect, the purge pump and the flow rate control valve are not provided in the flow passage of the gas from the fuel tank during oil feeding to the fuel tank.

DETAILED DESCRIPTION

Figure 1:
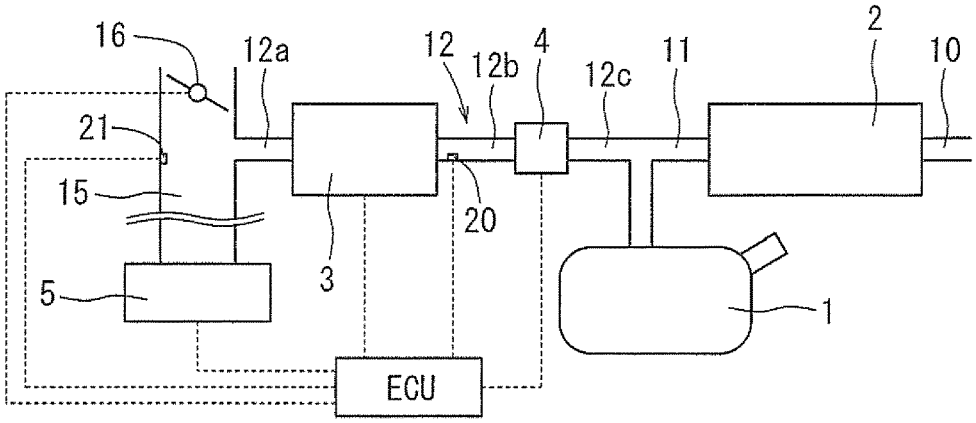
FIG. 1 is a schematic view of an evaporated fuel processing device.

As shown in FIG. 1, an evaporated fuel processing device may be adopted to a vehicle, such as an automobile, and includes a fuel tank 1, a canister 2, a purge pump 3 and a flow rate control valve 4. Further, the evaporated fuel processing device has an atmospheric passage 10 facilitating communication between the canister 2 and the atmosphere, a vapor passage 11 facilitating communication between the fuel tank 1 and the canister, an intake pipe 15, and a purge passage 12 communicating the intake pipe 15 with the canister 2.

The fuel tank 1 is a sealed tank with a pressure resistance. Highly volatile fuel, such as a gasoline, may be reserved within the fuel tank 1. A fuel pump (not shown) for pumping the fuel to an engine (internal combustion engine 5) is arranged within the fuel tank 1.

The canister 2 serves to selectively adsorb or desorb the evaporated fuel generated in the fuel tank 1. An adsorbent material (not shown) is filled within the canister 2. A porous material, which is air-permeable and capable of adsorbing or desorbing the evaporated fuel, may be used as an adsorbent material. As such a porous material, an activated carbon may favorably be used.

The intake pipe 15 is a pipe for feeding the atmospheric air to the internal combustion engine (engine) 5. A throttle valve 16 is provided within the intake pipe 15 wherein the degree of opening of the throttle valve 16 may be controlled by an engine control unit (ECU). The degree of opening of the throttle valve 16 is controlled by the ECU in accordance with a pedaling amount of an accelerator (not illustrated), etc.

The vapor passage 11 is, for example, a piping for facilitating communication between the fuel tank 1 with the canister 2. The purge passage 12 serves to facilitate communication between the intake pipe 15 and the atmospheric passage 10. The purge passage 12 includes a piping 12*a* for facilitating communication between the intake pipe 15 with the purge pump 3, a piping 12*b* for facilitating communication between purge pump 3 with the flow rate control valve 4, and a piping 12*c* for facilitating communication between the flow rate control valve 4 with the canister 2. The piping 12*c* is branched off from the vapor passage 11. Specifically, the piping 12*c* includes a first portion for facilitating communication between a branched part of the vapor passage 11 and the flow rate control valve 4 as well as a second portion, which is also a part of the vapor passage 11, for communicating the branched part of the first portion with the canister 2. More specifically, the purge passage 12 includes the pipings 12*a* to 12*c*, the canister 2, the flow rate control valve 4 and the purge pump 3, and all of these components collectively facilitate communication between the atmospheric passage 10 and the intake pipe 15. The purge passage 12 communicates with a portion of the intake pipe 15 downstream of the throttle valve 16 within the intake pipe 15.

The purge pump 3 serves to forcibly feed the gas under pressure from the canister 2 toward the intake pipe 15 and is provided in the purge passage 12, between the intake pipe 15 and the canister 2. A vortex pump (turbo pump) may be used as a purge pump 3. Furthermore, said vortex pump may also be referred to as a Wesco pump.

Figure 2:
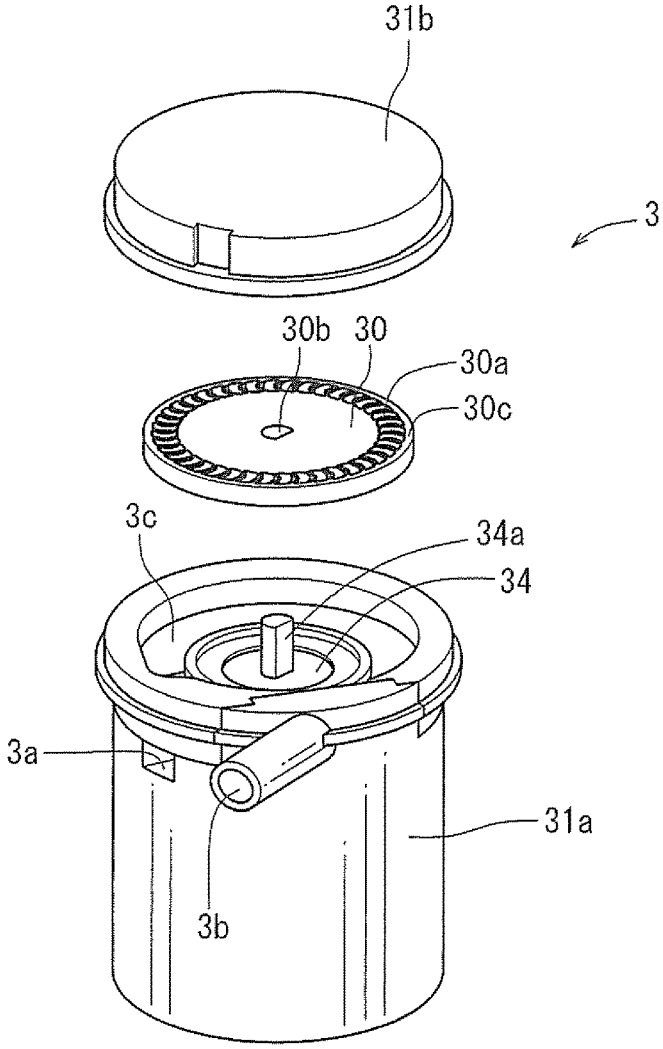
FIG. 2 is an exploded perspective view of a purge pump.
Figure 3:
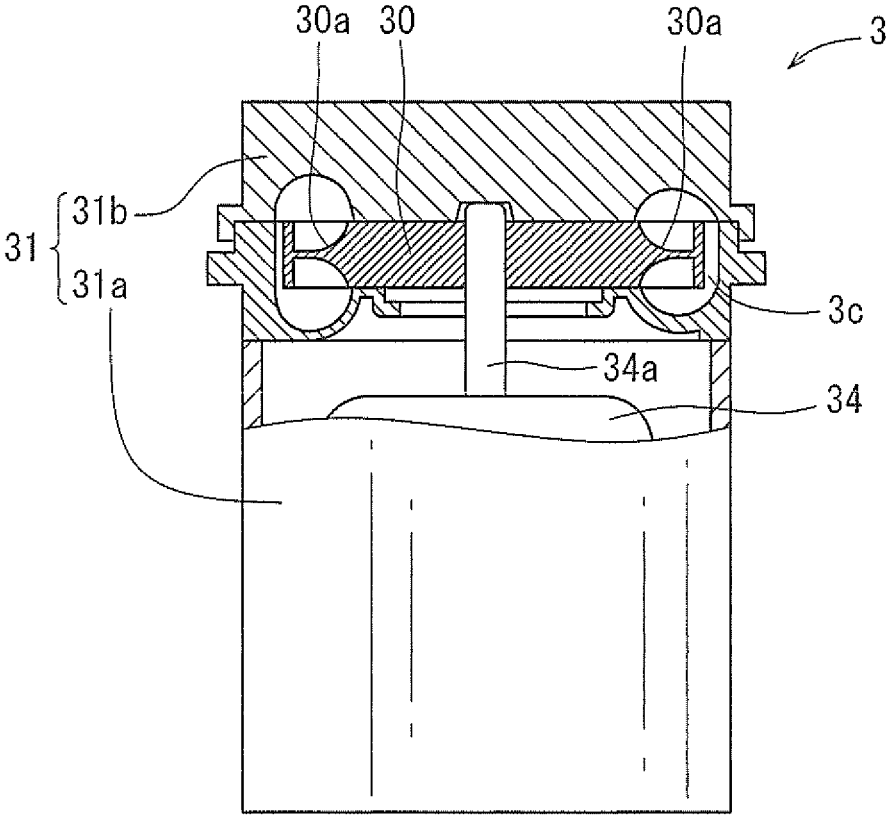
FIG. 3 is a partial cross-sectional view of the purge pump.
Figure 4:
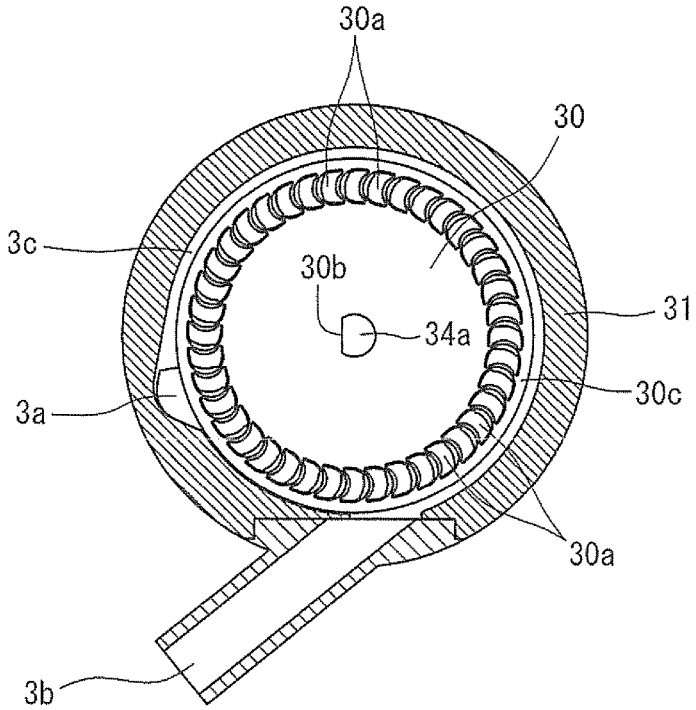
FIG. 4 is a transverse cross-sectional view of the purge pump.

As shown in FIGS. 2 to 4, the purge pump 3 has a disk-like impeller 30 and a housing 31 accommodating the impeller 30. A plurality of grooves 30*a* are arranged along the outer peripheral radial edge of the impeller 30 such that vanes 30*c* are formed between the grooves 30*a*. A semicircular shaped shaft hole 30*b* is drilled in the radial center of the impeller 30. The housing 31 has a housing main body 31*a* with a space for accommodating the impeller 30 and a cover 31*b* configured to cover an upper side of the housing main body 31*a* as well as the impeller 30. A suction port 3*a* and discharge port 3*b* of the purge pump 3 are formed on the upper part of the housing main body 31*a*. The suction port 3*a* is formed in a wall of the housing main body 31*a*. The discharge port 3*b* is formed to have a projecting nozzle-like configuration, which extends tangentially outwardly from the housing main body 31*a*.

A motor 34 is accommodated in a lower part of the housing main body 31*a* as a rotation driving means for the impeller 30. The motor 34 is connected to a power source (not shown) provided to a vehicle. A rotary shaft 34*a* of the motor 34 is inserted into the shaft hole 30*b* of the impeller 30 when the impeller 30 is accommodated in the housing 31, wherein the rotary shaft 34*a* is parallel to the longitudinal direction of the pump 3. The shaft hole 30*b* and the rotary shaft 34 have the same configuration and are formed as semicircular shape. Due to this shape, the impeller 30 is non-rotatably connected to the rotary shaft 34*a* by inserting the rotary shaft 34*a* into the shaft hole 30*b*. Because the shape is noncircular, this prevents the impeller 30 from rotating with respect to the rotary shaft 34*a*. Therefore, the impeller 30 rotates about the rotary shaft axis at the radial center of the housing 31 only as the rotary shaft 34*a* rotates.

A flow passage 3*c* for communicating the suction port 3*a* with the discharge port 3*b* is defined between the housing main body 31*a* and the cover 31*b*. The flow passage 3*c* is provided within the housing 31 to encircle the outer peripheral edge of the impeller 30 comprising the grooves 30*a*. Therefore, via this structural configuration, the suction port 3*a* is always able to communicate with the discharge port 3*b* through the flow passage 3*c*. Thus, the gas can flow through the inside the purge pump 3 even when the purge pump 3 is not being driven. In the cross-sectional plane of the flow passage 3*c* perpendicular to the rotary shaft axis 34*a*, as said shaft is traversed in the vertical direction of the pump from the suction port 3*a* to the discharge port 3*b*, the gap between the outer radial peripheral edge of passage 3*c*, and outermost radial extent of grooves 30*a* gradually reduces. The flow passage 3*c* has a minimal gap portion, which comprises the smallest distance between the outer radial peripheral edge of passage 3*c* and the outermost radial extent of grooves 30*a*, at the cross-sectional plane corresponding to the pump height in the vicinity of the discharge port 3*b*. The cross-sectional area of the minimal gap portion has a radial dimension equal to or larger than that of the cross-sectional area of the internal space of the atmospheric passage 10, the canister 2 and the pipings 12*a* to 12*c* of the purge passage 12, wherein the cross-sectional areas correspond to the planes perpendicular to the longitudinal axes of these pipings.

The purge passage 12 and the vapor passage 11 have a common part from which they branch off of. Strictly speaking, a part of the vapor passage 11 (extending from a branched part of the vapor passage 11 and the purge passage 12 to the canister 2) is also a part of the purge passage 12. Therefore, the cross-sectional area of the minimum diameter portion of the purge pump 3 is at least equal to or larger than the minimum cross-sectional area of a part of the vapor passage 11 (the common part with the purge passage 12).

The flow rate control valve 4 is also provided in the purge passage 12. Specifically, it is provided in the purge passage 12 closer to the canister 2 side with relative to the purge pump 3. More specifically, the flow rate control valve 4 is provided at the upstream of the purge pump 3 in the purge direction. For example, a solenoid valve may be used as the flow rate control valve 4. An opening/closing timing of the flow rate control valve 4 is controlled by an ECU mounted on a vehicle, and a valve opening rate (gas flow rate) in the purge passage 12 is controlled by a duty control cycle based on the ratio between the valve-opening time and the valve-closing time.

A pressure sensor 20 may be provided for detecting the pressure. For example, the pressure sensor may be provided between the purge pump 3 and the flow rate control valve 4 (at the upstream side of the purge pump 3 downstream of flow rate control valve 4 in the purge direction). Additionally or alternatively, the pressure sensor(s) may be provided at either one of, or at both of a position between purge pump 3 and intake pipe 15, and a position in the intake pipe 15. Information regarding the pressure detected by each pressure sensor may be transmitted to the ECU as detected signals. The valve opening rate of the flow rate control valve 4 and the drive timing of the purge pump 3 may be controlled by the ECU based on these detected signals sent to the controller by each pressure sensor.

Next, an evaporated fuel processing mechanism by the evaporated fuel processing device will be described. During parking (when a key is turned off) or during oil feeding, the evaporated fuel generated within the fuel tank 1 flows into the canister 2 through the vapor passage 11. At this time, the purge pump 3 is stopped and the flow rate control valve 4 is completely closed. Therefore, the evaporated fuel generated within the fuel tank 1 flows into the canister 2 through the vapor passage 11 and is selectively adsorbed and captured by the adsorption material within the canister 2. The residual air passes through the adsorption material and diffuses from the canister 2 through the atmospheric passage 10 into the atmosphere.

As a result, the pressure in the fuel tank 1 is released to prevent damage to the fuel tank 1 while at the same time air contamination is avoided. Further, the purge pump 3 and the flow rate control valve 4 are not arranged in the passage through which the evaporated fuel generated within the fuel tank 1 flows into the canister 2 to be adsorbed in the canister 2. Consequently, the evaporated fuel may flow into the canister 2 without being disturbed by the purge pump 3 and the flow rate control valve 4.

The valve opening rate in the flow rate control valve 4 (i.e. gas flow rate in the purge passage 12) and the drive timing of the purge pump 3 are controlled by the ECU when the vehicle is being driven. The purge pump 3 is held in a stopped position when sufficient negative pressure, past a predetermined amount, is generated in the intake pipe 15. For example, the ECU stops the purge pump 3 when the ECU determines the absolute value of the negative pressure measured by a pressure sensor 21 (i.e. the negative pressure is lower than the atmospheric pressure) in the intake pipe 15 is greater than a prescribed predetermined value based on the detected signals sent from the pressure sensor, which is, for example, provided in the intake pipe 15.

However, in this case, the gas can pass through the purge pump 3 even when the purge pump 3 is stopped, when the vehicle is being driven, via aforementioned passage 3*c*. Therefore, similarly, the negative pressure from the intake pipe 15 is also applied through the passage 3*c* of purge pump 3 onwards to the canister 2 and the fuel tank 1, when flow control valve 4 is open. Consequently, the evaporated fuel is desorbed from the inside of the canister 2, utilizing only said negative pressure in the intake pipe. At this time, the atmospheric air is simultaneously introduced from the atmospheric passage 10 into the canister 2, and this atmospheric air along with the negative pressure from the intake pipe 15 facilitates desorption of the evaporated fuel.

Further, the cross-sectional area of the minimum diameter portion of the purge pump 3 is configured to be larger than the cross-sectional area perpendicular to the longitudinal axis of the internal space of the other parts of the purge passage 12. More specifically, the passage in the purge pump 3 has a larger cross-sectional area than that of the other parts of the purge passage 12. Therefore, the pressure loss in the purge pump 3 is less than the pressure loss in the other parts of the purge passage 12. Since the purge pump 3 due to its large cross-sectional area hardly disturbs the gas flow, the purge pump 3 has a lesser effect on reduction of the desorbing efficiency when the canister 2 desorbs the evaporated fuel utilizing only negative pressure in the intake pipe 15. The flow rate control valve 4 is substantially fully opened when the evaporated fuel is desorbed utilizing only the negative pressure in the intake pipe. The evaporated fuel desorbed from the canister 2 may be fed to the intake pipe 15 together with the evaporated fuel generated within the fuel tank 1.

The purge pump 3 is driven when the absolute value of he negative pressure generated in the intake pipe 15 is not sufficient or substantially close to the aforementioned predetermined value. For example, the ECU drives the purge pump 3 when the ECU determines that the absolute value of the negative pressure in the intake pipe 15 is smaller than the predetermined value or when the ECU determines that the pressure in the intake pipe 15 is a positive pressure (i.e. the pressure is higher than the atmospheric pressure) based on the detected signals sent by the pressure sensor 21 that is provided in the intake pipe 15. As a result, the impeller 30 rotates around the axis to forcibly flow the gas from the canister 2 side of the purge pump 3 to the intake pipe 15 side of the purge pump 3. Consequently, this generates a pressure gradient resulting in the desorption of the evaporated fuel in the canister 2 from the adsorption material as the negative pressure is applied to the fuel tank 1 and the canister 2. In this case as well, the atmospheric air is simultaneously introduced from the atmospheric passage 10 into the canister 2, and the atmospheric air facilitates desorption of the evaporated fuel. The evaporated fuel desorbed from the canister 2 may be fed into the intake pipe 15 along with the evaporated fuel generated in the fuel tank 1.

When the purge pump 3 is driven, because the flow rate control valve 4 is open, it adjusts the pressure such that the pressure upstream of the purge pump 3 in the purge direction becomes a negative pressure. Particularly, when the purge pump 3 is driven, the pressure at the downstream side of the purge pump 3 in the purge direction becomes a positive pressure when the pressure within the intake pipe 15 is close to the atmospheric pressure. In this case, the absolute value of the negative pressure at the upstream side of the purge pump 3 in the purge direction is controlled by the opening of the flow rate control valve 4 to be greater than the positive pressure value at the downstream side of the purge pump 3. In particular, the ECU controls the opening angle/degree of the flow rate control valve 4 based on the detected signals sent by the pressure sensors that are provided at the upstream side and downstream side of the purge pump 3 while the purge pump 3 is driven. More specifically, the ECU controls the flow rate control valve 4 such that the absolute value of the negative pressure at the upstream side of the purge pump 3 becomes greater than the absolute value of the positive pressure at the downstream side of the purge pump 3.

Therefore, the positive pressure at the downstream side in the purge direction caused by the driving of the pump 3 will be compensated for by the greater negative pressure at the upstream side in the purge direction after the purge pump 3 is stopped, resulting in a net negative pressure. This compensation prevents the positive pressure from applying to the canister 2 immediately after the purge pump 3 is stopped. Consequently, this also prevents the evaporated fuel within the canister 2 from being diffused through the atmospheric passage 10 immediately after the purge pump 3 is stopped. Further, the purge pump 3 may be inertially driven even after a stop signal is transmitted from the ECU. On the other hand, the flow rate control valve 4 can be immediately closed as soon as the stop signal is transmitted from the ECU since the flow rate control valve 4 is a solenoid valve. The gas flow from the purge pump 3 to the canister 2 can be prevented since the flow rate control valve 4 can be closed before the purge pump 3 is stopped. This prevents any adverse effect on the canister 2.

Figure 5:
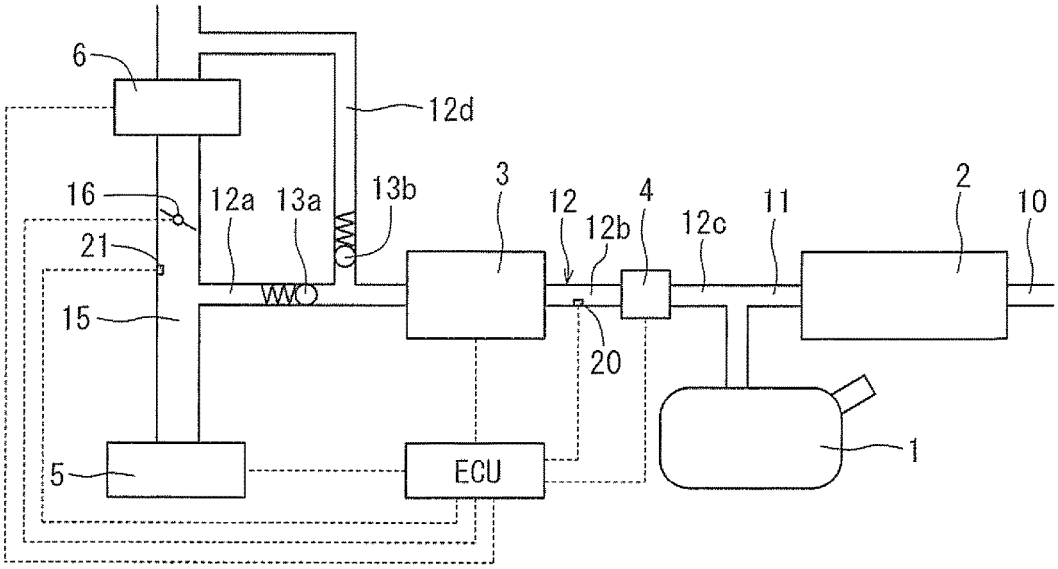
FIG. 5 is a schematic view of an evaporated fuel processing device according to another embodiment.

As an alternative to the configuration shown in FIG. 1, the evaporated fuel processing device may have an alternative configuration shown in FIG. 5. The evaporated fuel processing device shown in FIG. 5 may have a similar essential structure and exhibit similar operational effect as the evaporated fuel processing device shown in FIG. 1. Hereinafter, the embodiment of FIG. 5 will be described mainly in terms of its differences from the embodiment of FIG. 1.

The evaporated fuel processing device in FIG. 5 may also include the fuel tank 1, the canister 2 for absorbing the evaporated fuel generated in the fuel tank 1, the atmospheric passage 10 for facilitating communication between the canister 2 and the atmosphere, and a vapor passage 11 for facilitating communication between the fuel tank 1 and the canister 2. The evaporated fuel processing device may further include the intake pipe 15 for supplying the atmospheric air to an engine (internal combustion engine 5), the purge passage 12 for facilitating communication between the intake pipe 15 and the canister 2, the purge pump 3 for forcibly feeding the air under pressure from the canister 2 to the intake pipe 15, and the flow rate control valve 4 consisting of a solenoid valve. The purge pump 3 and the flow rate control valve 4 are arranged in the purge passage 12.

The evaporated fuel processing device in FIG. 5 may have a supercharger 6 in the intake pipe 15 at the upstream side of the throttle valve 16, relative to the flow path from the supercharger 6 to the internal combustion engine 5, in which the throttle valve 16 lies. The piping 12*d* may be branched off from the piping 12*a* disposed between the purge pump 3 and the intake pipe 15. More specifically, downstream of the purge pump 3 in the purge direction, the purge passage 12 may be branched off into the first purge passage (piping 12*a*) and the second purge passage (piping 12*d*), wherein the first purge passage facilitates communication between the purge pump 3 and the area downstream of the throttle valve 16 in the intake pipe 15 in the flow path from the supercharger 6 to the internal combustion engine 5, and wherein the second purge passage facilitates communication between the purge pump 3 and the upstream side of the supercharger 6 in the intake pipe 15, relative to the flow path from the supercharger 6 to the internal combustion engine 5. Check valves (one way valve) 13*a* and 13*b* may respectively be provided in the first and second purge passages (pipings 12*a* and 12*d*) allowing the gas to flow only from the purge pump 3 side to the intake pipe 15 side. Both check valves 13*a* and 13*b* may open when the differential pressure between the pressures upstream and downstream relative to each of the check valves, respectively, is equal to or more than a predetermined value. Each of the respective differential pressures—(valve opening pressures) for both check valves 13*a* and 13*b*, may be set to the same differential pressure.

During parking (when a key is turned off) or oil feeding, the evaporated fuel generated within the fuel tank 1 may be adsorbed and captured in the canister 2. Further, since sufficient negative pressure is heretofore generated in the intake pipe 15 while the vehicle is being driven, during the parking or oil feeding time the evaporated fuel may be desorbed utilizing only the intake pipe negative pressure by stopping the purge pump 3. In particular, the ECU may stop the purge pump 3 when the ECU determines that the absolute value of the negative pressure in the intake pipe 15 is larger than the predetermined value based on the detected signals sent by the pressure sensor provided in the intake pipe 15. When sufficient negative pressure is not able to be generated in the intake pipe 15, the purge pump 3 may be controlled to be driven and the flow rate control valve 4 may be controlled to be opened. For example, the ECU may drive the purge pump 3 when the ECU determines that the absolute value of the negative pressure in the intake pipe 15 is smaller than the predetermined value or that the pressure is positive based on the detected signals sent by the pressure sensor provided in the intake pipe 15. In this way the evaporated fuel may be desorbed from the canister 2.

According to the evaporated fuel processing device in FIG. 5, the supercharger 6 is provided in the intake pipe 15. In this case, the pressure upstream of the supercharger 6, relative to the flow path from the supercharger 6 to the internal combustion engine 5, may likely be substantially atmospheric pressure, and due to the presence of the supercharger 6, the pressure at the downstream of the supercharger 6 becomes positive pressure. Therefore, when the pressure at the downstream of the supercharger 6, relative to the flow path from the supercharger 6 to the internal combustion engine 5 is negative, the check valve 13*a* in the first purge passage (piping 12*a*) may open as the check valve 13*a* receives the negative pressure from the intake pipe 15 as well as the supply pressure from the purge pump 3 so that the gas may flow through the same route as that of the embodiment of the FIG. 1, from purge pump 3 towards the intake pipe 15. On the other hand, when the pressure downstream of the supercharger 6 is positive, the check valve 13*a* in the first purge passage (piping 12*a*) will not open by receiving the positive pressure, due to the one-way nature of the check valve. If the pressure downstream of the supercharger 6 is positive pressure and higher than the pressure upstream of the supercharger 6, relative to the flow path from the supercharge 6 to the internal combustion engine 5, the check valve 13*b* in the second purge passage (piping 12*d*) may open as it receives the supply pressure from the purge pump 3. As a result, the gas may flow through the second purge passage (piping 12*d*).

The various examples described above in detail with reference to the attached drawings are intended to be representative of the present invention and thus non limiting embodiments. The detailed description is intended to teach a person of skill in the art to make, use and/or practice various aspects of the present teachings and thus does not limit the scope of the invention in any manner. Furthermore, each of the additional features and teachings disclosed above may be applied and/or used separately or with other features and teachings in any combination thereof, to provide improved evaporated fuel processing device, and/or methods of making and using the same.

The invention claimed is:

1. An evaporated fuel processing device comprising:

a fuel tank;

a canister coupled to the fuel tank and configured to adsorb evaporated fuel generated in the fuel tank;

an atmospheric passage extending from the canister and in fluid communication with the surrounding atmosphere;

a vapor passage extending between the fuel tank and the canister;

an intake pipe coupled to an internal combustion engine and configured to supply atmospheric air to the internal combustion engine;

a purge passage configured to facilitate fluid communication between the intake pipe and the canister; and a purge pump disposed along the purge passage and configured to pump an air through the purge passage from the canister to the intake pipe;

wherein the evaporated fuel is configured to be desorbed from the inside of the canister utilizing a negative pressure generated in the intake pipe by stopping the purge pump when an absolute value of the negative pressure in the intake pipe is larger than a predetermined value, wherein the evaporated fuel is configured to be desorbed from the inside of the canister utilizing the driving of the purge pump when the absolute value of the negative pressure in the intake pipe is smaller than the predetermined value or when the pressure in the intake pipe is a positive pressure value, wherein a gas is configured to flow through the canister and the purge passage to the intake pipe while the atmospheric air is introduced as an air for facilitating the purge when the evaporated fuel is desorbed from inside the canister, wherein the purge pump is a vortex pump comprising a disk-like impeller and a housing configured to accommodate the impeller, wherein the disk-like impeller includes a plurality of grooves or vanes that are arranged tangentially along an outer peripheral edge of the disk-like impeller and are arranged side by side to each other, wherein the housing includes a suction port and a discharge port, wherein the impeller rotates around an axis within the housing, wherein a flow passage is defined within the housing between the housing and the outer peripheral edge of the impeller, and wherein the flow passage is in fluid communication with the suction port and the discharge port, and wherein the minimum cross-sectional area of the flow passage moving from the suction port to the discharge port is equal to or larger than the minimum cross-sectional area of an internal space of the atmospheric passage, the canister and the purge passage.

2. An evaporated fuel processing device comprising:

a fuel tank;

a canister coupled to the fuel tank and configured to adsorb evaporated fuel generated in the fuel tank;

an atmospheric passage extending from the canister and configured to facilitate communication between the canister and the surrounding atmosphere;

a vapor passage extending between the fuel tank and the canister;

an intake pipe coupled to an internal combustion engine and configured to supply atmospheric air to the internal combustion engine;

a purge passage configured to facilitate fluid communication between the intake pipe and the canister; and a purge pump disposed along the purge passage and configured to pump an air through the purge passage from the canister to the intake pipe;

wherein the evaporated fuel is configured to be desorbed from the inside of the canister utilizing a negative pressure generated in the intake pipe by stopping the purge pump when an absolute value of the negative pressure in the intake pipe is larger than a predetermined value, wherein the evaporated fuel is configured to be desorbed from the inside of the canister utilizing the driving of the purge pump when the absolute value of the negative pressure in the intake pipe is smaller than the predetermined value or when the pressure in the intake pipe is a positive pressure value, a gas configured to flow through the canister and the purge passage to the intake pipe while the atmospheric air is introduced as an air for facilitating the purge when the evaporated fuel is desorbed from inside the canister, wherein the purge pump is a vortex pump comprising a disk-like impeller and a housing configured to accommodate the impeller, wherein the disk-like impeller includes a plurality of grooves or vanes that are arranged tangentially along an outer peripheral edge of the disk-like impeller and are arranged side by side to each other, wherein the housing has a suction port and a discharge port, wherein the impeller rotates around an axis within the housing, wherein a flow passage is defined within the housing between the housing and the outer peripheral edge of the impeller, and wherein the flow passage is in fluid communication with the suction port and the discharge port, and wherein a pressure loss per unit length of the flow passage of the purge pump from the suction port to the discharge port is configured to be equal to or less than a pressure loss per length of pipes for the atmospheric passage, the canister and the purge passage.

3. The evaporated fuel processing device of claim 1, wherein said device further comprises a flow rate control valve disposed along the purge passage upstream of the purge pump, wherein the flow rate control valve is positioned between the canister and the purge pump.

4. The evaporated fuel processing device of claim 1, wherein neither the purge pump nor the flow rate control valve is provided in the flow passage of the gas from the fuel tank during oil feeding to the fuel tank.

5. The evaporated fuel processing device of claim 2, wherein said device further comprises a flow rate control valve disposed along the purge passage upstream of the pump, wherein the flow rate control vale is provided between the canister and the purge pump.

6. The evaporated fuel processing device of claim 2, wherein neither the purge pump nor the flow rate control valve is provided in the flow passage of the gas from the fuel tank during oil feeding to the fuel tank.

7. An evaporated fuel processing device comprising:

a fuel tank;

a canister coupled to the fuel tank and configured to adsorb evaporated fuel generated in the fuel tank;

an atmospheric passage having a first end coupled to the canister and a second end open to the surrounding atmosphere;

a vapor passage comprising branched piping configured to facilitate fluid communication between the fuel tank and the canister;

an intake pipe coupled to an internal combustion engine and configured to supply atmospheric air to the internal combustion engine;

a purge passage comprising piping configured to facilitate fluid communication between the intake pipe and the canister; and a purge pump disposed along the purge passage and configured to pump an air through the purge passage from the canister to the intake pipe, wherein:

wherein the evaporated fuel is configured to be desorbed from the inside of the canister utilizing a negative pressure generated in the intake pipe by stopping the purge pump when an absolute value of the negative pressure in the intake pipe is larger than a predetermined value, wherein the evaporated fuel is configured to be desorbed from the inside of the canister utilizing the driving of the purge pump when the absolute value of the negative pressure in the intake pipe is smaller than the predetermined value or when the pressure in the intake pipe is a positive pressure value, wherein a gas is configured to flow through the canister and the purge passage to the intake pipe while the atmospheric air is introduced for facilitating the purge when the evaporated fuel is desorbed from inside the canister, wherein the purge pump is a vortex pump comprising a disk-like impeller rotatably disposed in a cylindrical housing, wherein the disk-like impeller includes a plurality of grooves or vanes arranged side by side along an outer peripheral edge of the disk-like impeller, wherein the housing has a suction port and a discharge port, wherein the impeller rotates around a rotary shaft axis at the radial center of the housing parallel to the longitudinal direction of the housing, wherein a flow passage is defined within the housing between the housing and the outer peripheral edge of the impeller, and wherein the flow passage provides fluid communication between the suction port and the discharge port, and wherein the minimum cross-sectional area of the flow passage of the cylindrical purge pump leading from the suction port to the discharge port, within the pump housing and perpendicular to the longitudinal axis of said housing, is equal to or larger than the minimum cross-sectional area of the internal space of the canister, the atmospheric passage, and the purge passage, wherein the cross-sectional areas correspond to the cross-sectional planes perpendicular to the longitudinal axis of the canister, the atmospheric passage, and the purge passage, wherein the pressure loss per unit length of the flow passage of the purge pump from the suction port to the discharge port is configured to be equal to or less than a pressure loss per length of the canister and piping comprising the atmospheric passage, and purge passage.

8. The device of claim 7, further comprising an ECU controller, where the ECU controller is configured to control the drive timing of the purge pump and the valve opening rate of a flow control valve provided between the canister and the purge pump, wherein the valve is a solenoid valve.

9. The device of claim 8, wherein the ECU controller is configured to control the purge pump based on detected signals from one or more pressure sensors, wherein the one or more pressure sensors are provided between the purge pump and the flow control valve, or between the purge pump and the intake pipe.

10. The device of claim 9, wherein the ECU controller is configured to control the device such that the purge pump is held in a stopped position when a sufficient amount of negative pressure, with an absolute value greater than a predetermined amount, is generated in the intake pipe, and wherein the pump is driven when the absolute value is less than said predetermined amount.

11. The device of claim 7, wherein the radial center of the impeller comprises a semicircular-shaped shaft hole that mates with the rotary shaft to prevent relative rotation therebetween.

12. The device of claim 7 wherein the suction port comprises an inlet to the housing.

13. The device of claim 12, wherein the discharge port comprises a pipe extending tangentially from the housing.

14. The device of claim 7, wherein the flow passage is concentrically disposed about the outer peripheral edge of the impeller.

15. The device of claim 7, wherein the flow passage has a minimal gap portion comprising the smallest distance between the outer radial peripheral edge of the flow passage and the outermost radial extent of the grooves or vanes of the impeller, wherein said minimal gap location is proximal the discharge port.

16. The device of claim 15, wherein the cross-sectional area of the minimal gap portion has a radial dimension equal to or larger than that of the cross-sectional area of the internal space of the atmospheric passage, the canister, and the purge passage.

17. The device of claim 10, wherein when evaporated fuel generated within the fuel tank flows into the canister, the ECU controller is configured to control the device such that the purge pump is stopped and the flow rate control valve is completely closed.

18. The device of claim 8, wherein the ECU configured to control the flow control valve opening rate by a duty control cycle based on the ratio between the valve-opening time and the valve closing time.

19. The device of claim 7, wherein the purge passage comprises two branched passages leading to the intake pipe.

20. The device of claim 19, wherein each branched passage of the purge passage is located downstream of the purge pump, in the flow path from the purge pump to the intake pipe, wherein each branched passage comprises a one way check valve.

* * * * *